US011470975B2

(12) United States Patent
Boyer

(10) Patent No.: US 11,470,975 B2
(45) Date of Patent: Oct. 18, 2022

(54) STEP STOOL WITH STABILITY EXTENSION

(71) Applicant: Mark Boyer, Hilton Head, SC (US)

(72) Inventor: Mark Boyer, Hilton Head, SC (US)

( * ) Notice: Subject to any disclaimer, the term of this patent is extended or adjusted under 35 U.S.C. 154(b) by 393 days.

(21) Appl. No.: 16/743,446

(22) Filed: Jan. 15, 2020

(65) Prior Publication Data

US 2020/0237102 A1 Jul. 30, 2020

Related U.S. Application Data

(60) Provisional application No. 62/796,289, filed on Jan. 24, 2019.

(51) Int. Cl.
*A47C 12/00* (2006.01)
*A47C 7/00* (2006.01)

(52) U.S. Cl.
CPC ..... *A47C 12/00* (2013.01); *A47C 7/002* (2013.01)

(58) Field of Classification Search
CPC ..... A47C 12/00; A47C 7/002; A47C 16/02; A47C 16/04; A47C 16/025; A47C 12/02
USPC ..... 297/423.41, 423.44
See application file for complete search history.

(56) References Cited

U.S. PATENT DOCUMENTS 4,034,829 A * 7/1977 Hoffman ..... E06C 1/24 182/115
4,919,229 A * 4/1990 Wells ..... E06C 7/42 182/132
2011/0214942 A1* 9/2011 Niemiec ..... E04G 3/00 182/19
2012/0086317 A1* 4/2012 Baran ..... A47B 77/10 29/401.1
2014/0111072 A1* 4/2014 Camadella ..... A47B 88/413 312/235.1
2017/0226800 A1* 8/2017 Barry ..... A47C 12/00
2017/0370148 A1* 12/2017 Smith ..... E06C 1/005

* cited by examiner

*Primary Examiner* — Milton Nelson, Jr.
(74) *Attorney, Agent, or Firm* — Gardner Groff & Greenwald, PC

(57) ABSTRACT

A stepstool includes a stool body and a stability extension. The stool body includes a top step and a support structure that supports the top step. The stability extension projects distally from a base portion of the support structure and extends distally beyond a distal edge of the top step. The stability extension is configured to be received in a toe-space at the base of floor-standing furniture, and the stool body is configured so that the distal edge of the top step can be positioned immediately adjacent to the floor-standing furniture, to provide mechanical interference and thus prevent tipping of the stool body when a user on the top step leans out of balance. Also, the sides of the support structure can be angled outwardly to provide a wider base portion for improved stability of the stool body.

20 Claims, 7 Drawing Sheets

STEP STOOL WITH STABILITY EXTENSION

CROSS-REFERENCE TO RELATED APPLICATION

The present application claims the priority benefit of U.S. Provisional Patent Application Ser. No. 62/796,289, filed Jan. 24, 2019, which is hereby incorporated herein by reference in its entirety for all purposes.

TECHNICAL FIELD

The present invention relates generally to devices for a user to ascend to reach higher places, and particularly to general-purpose step stools for consumer use.

BACKGROUND

Conventional step stools include single or multiple (e.g., two or three) steps that a user can step up and stand on to reach higher places. Such general-purpose step stools for consumer use are commonly used in home and/or office spaces such as kitchens, bathrooms, bedrooms, living rooms, storage rooms, garages, etc. For example, these conventional step stools are often stood on to reach items on or above furniture, including but not limited to cabinets, shelves, countertops, tables, etc. This includes adults standing on step stools to reach overhead items on cabinets and storage shelves (e.g., cookware or dishes in overhead kitchen cabinets, medications in overhead bathroom cabinets, books on shelving units, etc.) and to reach other overhead furniture, appliance, and fixture items (e.g., light bulbs, curtains rods and drapes, wall-hanging artwork, etc.). This can also include children standing or sitting on step stools to reach onto a sink, vanity, countertop, and/or table (e.g., in a bathroom, kitchen, etc.) to wash their hands, brush their teeth, have a snack, etc., when the surface is too high for the child to reach without the step stool. Furthermore, this can include physically limited persons (e.g., elderly and/or injured persons) and pets ascending step stools to sit on beds, couchs, etc., when the surface is too high to reach without the step stool.

While conventional step stools are generally useful, they tend to be unstable during use. If a user leans in too far in any direction, the step stool can tip under the user's weight and thereby be thrust out from underneath the user. If the step stool tips and falls over like this, the user can fall and suffer injuries, for example from hitting the floor from an elevated position, from hitting the cabinet on the way down, and/or even from hitting the step stool itself during the fall.

Accordingly, it can be seen that needs exist for improvements to step stools to provide more stability during use. It is to the provision of solutions to these and other problems that the present invention is primarily directed.

SUMMARY

Generally described, the present invention relates to a stepstool including a stool body and a stability extension. The stool body includes a top step and a support structure that supports the top step. An optional bottom step can be positioned subjacent and proximal to the tope step. The stability extension projects distally from a base portion of the support structure and extends distally beyond a distal edge of the top step. The stability extension is configured to be received in a toe-space at the base of floor-standing furniture, and the stool body is configured so that the distal edge of the top step can be positioned immediately adjacent to the floor-standing furniture, to provide mechanical interference and thus prevent tipping of the stool body when a user on the top step leans out of balance. Also, the sides of the support structure can be angled outwardly to provide a wider base portion for improved stability of the stool body.

The specific techniques and structures employed to improve over the drawbacks of the prior devices and accomplish the advantages described herein will become apparent from the following detailed description of example embodiments and the appended drawings and claims.

DETAILED DESCRIPTION OF EXAMPLE EMBODIMENTS

Figure 1:
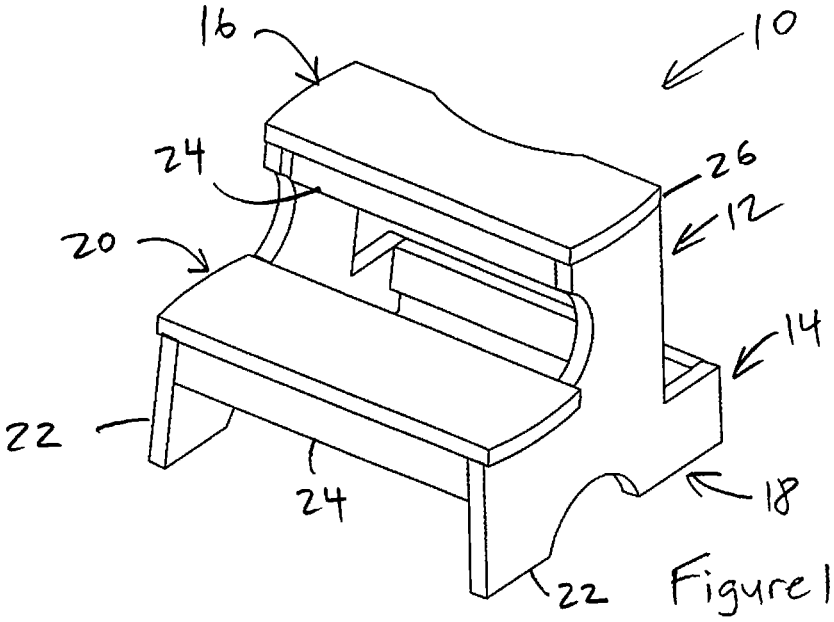
FIG. 1 is a front-side perspective view of a step stool with a stability extension according to a first example embodiment of the present invention.
Figure 2:
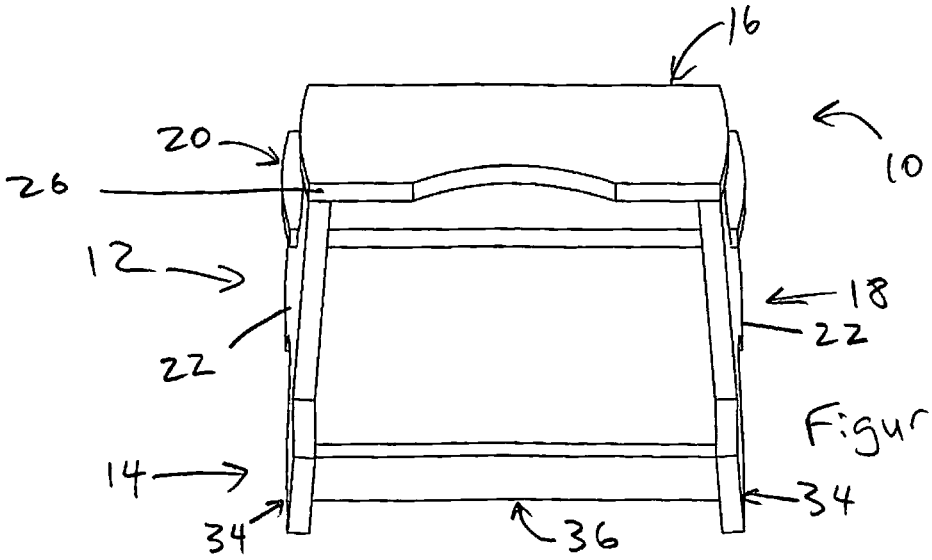
FIG. 2 is a rear-top perspective view of the step stool of FIG. 1.
Figure 3:
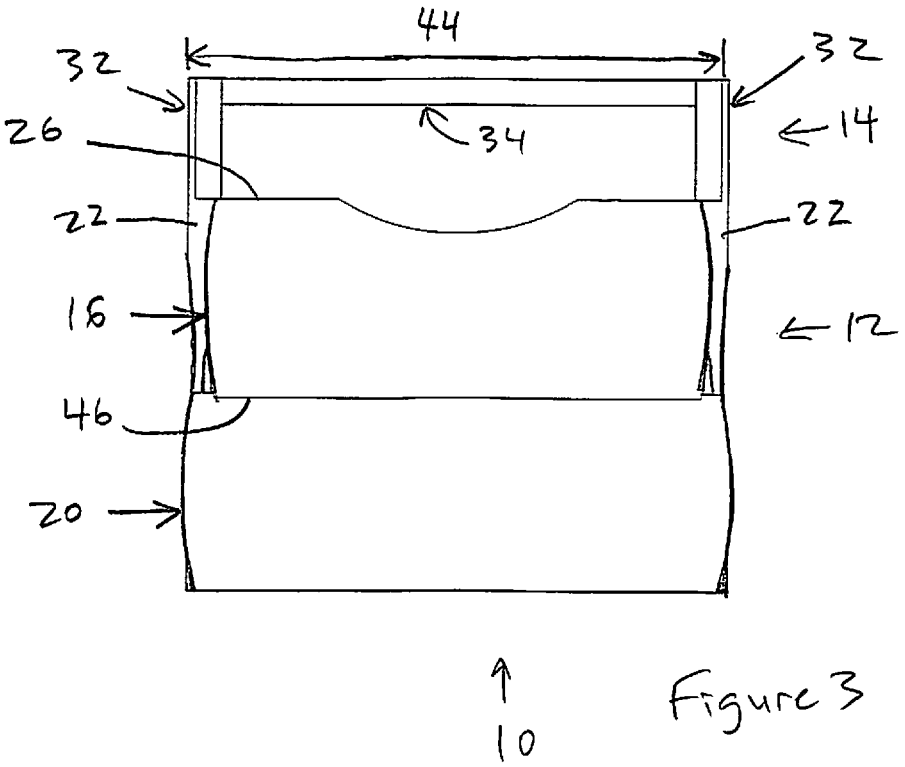
FIG. 3 is a top view of the step stool of FIG. 1.
Figure 4:
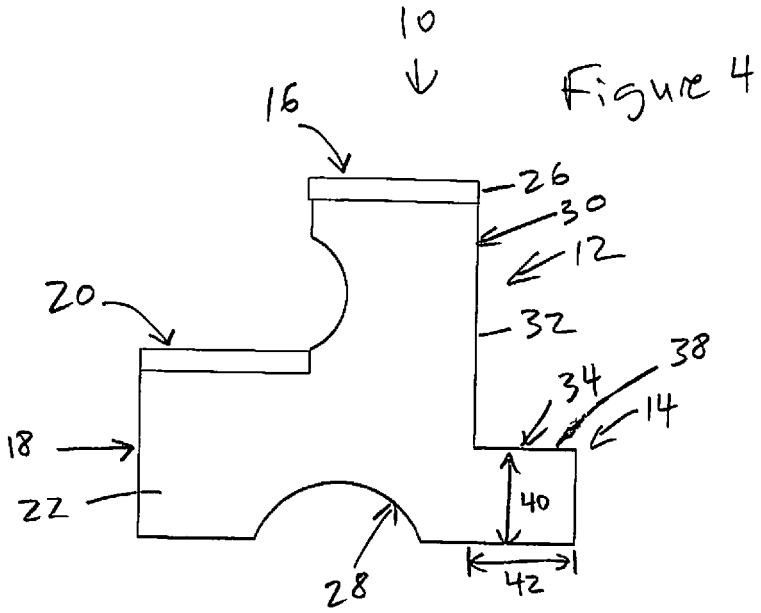
FIG. 4 is a side view of the step stool of FIG. 1.

Generally described, the present invention relates to a step stool with a stability extension for positioning in a toe-space at the base of a floor-standing furniture piece for improved stability of the stool. As used herein, the term "step stool" is intended to be broadly construed to include devices for ascending to reach higher places than can be reached unassisted, including conventional step stools and step ladders, having single or multiple steps, foldable or not, for use by adults, children, pets, and/or physically limited persons. The term "floor-standing furniture" is intended to be broadly construed to include cabinets (e.g., built-in and free-standing), cupboards, cases, counters, vanities, appliances (e.g., kitchen stoves and refrigerators), wardrobes/armoires, chests of drawers (i.e., dressers), beds, couches, bookshelves, wall units, shelving units, tables, desks, and other furniture and/or fixtures that are supported on a floor, for example of the type commonly used in kitchens, bathrooms, bedrooms, living rooms, storage rooms, offices, etc. And the term "toe-space" is intended to be broadly construed to include toe-kicks and other spaces that are formed at floor level at the base of a furniture piece and that allow a person to stand adjacent the furniture with their toes extending into that space without kicking the furniture base. As such, toe-spaces include for example notched/recessed spaces under cabinets, cupboards, and appliances, as well as spaces under and co-extensive with couches, beds, and chests (e.g., the open space under a couch that has four individual legs or feet, or two vertical end/side panels, supporting the rest of the couch up off the floor).

FIGS. 1-6 show a step stool 10 according to a first example embodiment of the present invention. The stepstool 10 includes a stool body 12 and a stability extension 14. The step stool 10 is designed and constructed for use with a floor-standing furniture piece 8 having a toe-space 6 at its base, with the stability extension 14 receivable in the toe-space 6 to provide improved stability for the stool body 12. While the drawings depict use with a cabinet 8 having a toe-kick 6, it will be understood that this is representative and for illustration purposes only, and the step stool 10 can be used with other floor-standing furniture having other toe-spaces, as described herein.

The step stool 10 can be made of materials, and by manufacturing techniques and equipment, that are well known for conventional step stools. For example, the step stool 10 can be made of wood materials (and/or of metals, plastics, composites, etc.) and its components can be assembled together using metal screws and/or bolts (and/or using other fasteners such as adhesives and/or mated joints such as mortise-and-tenon joints), with other embodiments including molded one-piece units.

The stool body 12 includes a top step 16 and a support structure 18 that supports the top step 16 above the floor. The top step 16 can be a horizontal board or panel, as depicted, or it can be a latticed or other structure having a rectangular or other shape (e.g., square, semi-circular, etc.). The depicted embodiment also includes a bottom step 20 positioned subjacent to, and of the same construction as, the top step 16. Other embodiments include only the top step, one or more intermediate steps (between the top and bottom steps), differently constructed steps, and/or other conventional steps adapted for the intended functionality as described herein. The top step 16 has a width (between its two lateral sides) selected to enable the user to place both feet on it in a side-by-side and comfortably spaced position, for example at least about 12 inches, typically about 16 inches to about 20 inches, or about 18 inches as in the depicted embodiment.

The support structure 18 can be a frame including two opposite side support frame members 22 that are spaced apart and across which the top and bottom steps 16 and 20 transversely extend, for example as depicted. The support structure frame 18 can also include one or more brace frame members 24 transversely extending between the side support frame members 22 for added structural strength. The depicted frame members 22 and 24 are assembled in a static configuration that does not permit folding for compact storage. In other embodiments, the support structure alternatively or additionally includes a tubular frame with corner posts/legs, a frame that folds for storage, a one-piece molded shell, or another conventional structure adapted for the intended functionality as described herein.

In typical embodiments, the support structure 18 is angled outwardly (as it extends downwardly from the top step 16) for enhanced stability during use when a user is on the top step 16. For example, the support structure 18 can be laterally angled outwardly on its opposing sides, such as by the depicted two side support frame members 22 being laterally angled outwardly as they extend downward from the top step 16 (e.g., see FIGS. 2-3). The support structure 18 is typically angled outwardly at an angle of about 5 degrees to about 15 degrees (for example about 5 degrees to about 10 degrees, or the depicted about 5 degrees) with respect to a vertical reference axis. The support structure 18 (at least its upper portion 30) is typically not angled outwardly on its distal side in order to allow a distal edge 26 of the top step 16 to be positioned immediately adjacent (abutting or only insignificantly separated from) the cabinet 8 during use, as depicted in FIGS. 5-6 and discussed in more detail next.

The stool body 12 is typically configured so that a least a portion of the distal side of its upright portion 30 can be positioned immediately adjacent to the floor-standing furniture 8 in use. This provides mechanical interference (with the cabinet 8 blocking the stool body 12 from tipping distally) and thus helps prevent tipping of the stool body 12 when a user on the top step 16 leans out of balance. In the depicted embodiment, the distal edge 26 of the top step 16 is positioned immediately adjacent the proximal side (e.g., doors or drawers) 5 of the cabinet 8, which additionally provides enhanced safety for the user on the top step 16. And the upright portion 30 of the support structure 18 has a distal side 32 that substantially aligns with the top-step distal edge 26 and that is substantially vertical so that it is also positioned immediately adjacent the proximal side 5 of the cabinet 8. In other embodiments, the support-structure distal side is not linear and instead has a concave or other regular or irregular profile/shape.

Figure 5:
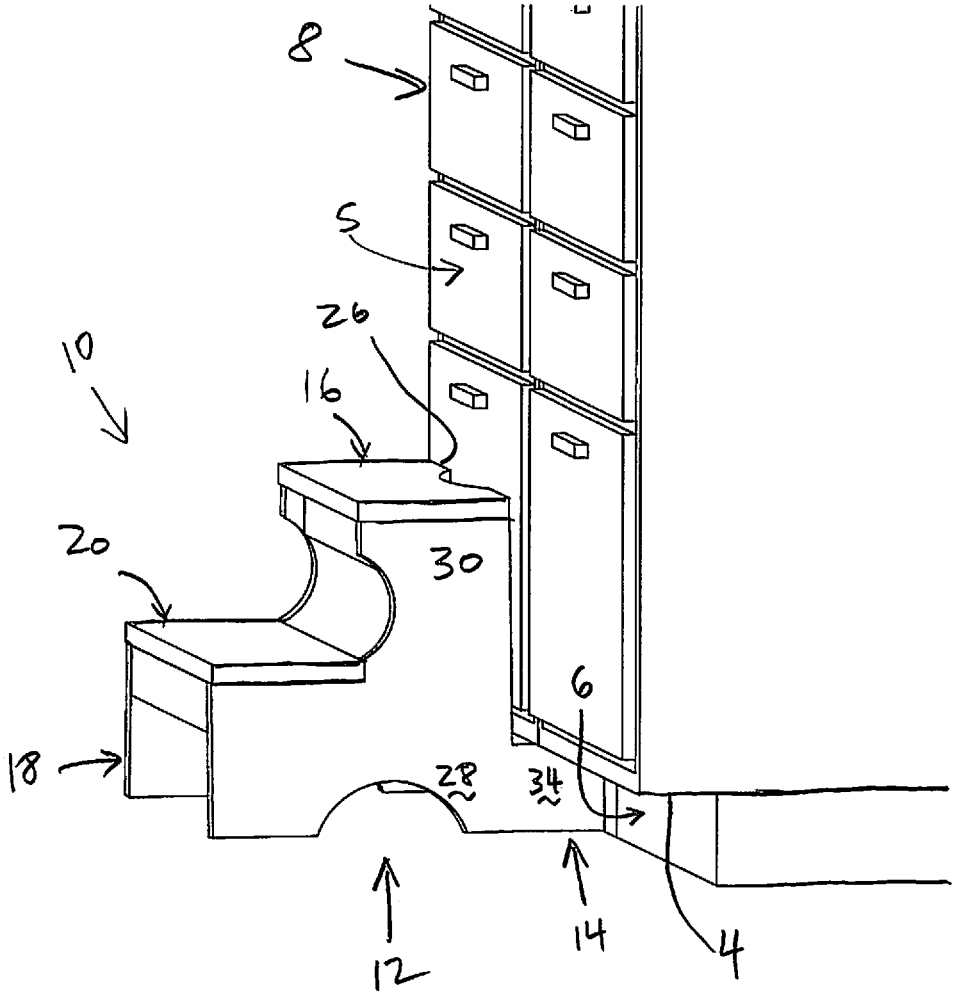
FIG. 5 is a front-side perspective view of the step stool of FIG. 1, shown in use with the stability extension positioned in a toe-space at the base of a conventional cabinet.
Figure 6:
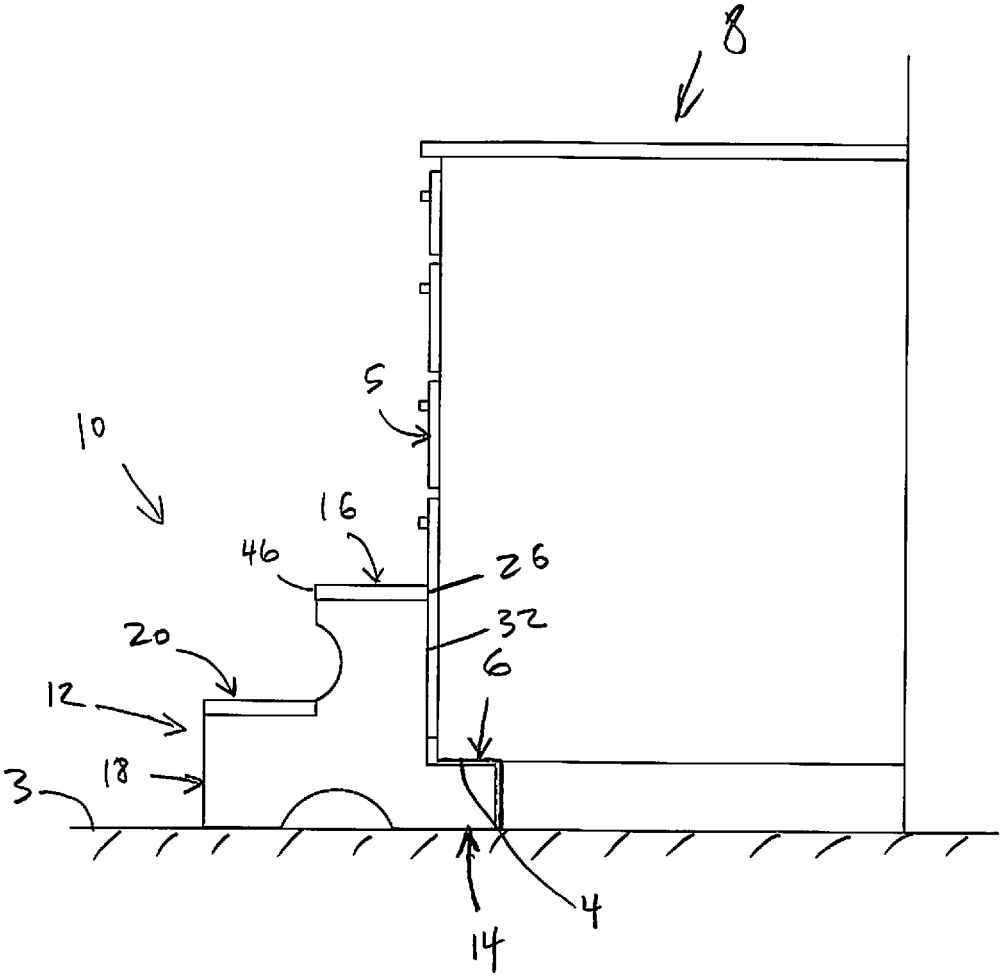
FIG. 6 is a side view of the step stool and cabinet of FIG. 5.

Having described the stool body 12, details of the stability extension 14 will now be provided with particular reference to FIGS. 5-6. The stability extension 14 projects distally (away from the user) from a base portion 28 of the support structure 18 and extends distally beyond the top-step distal edge 26. The base portion 28 is the lower portion of the support structure 18 adjacent the floor upon which the stool body 12 is supported and below the upright portion 30, which is the upper portion of the support structure 18 across which the top step 16 transversely extends.

The stability extension 14 is configured to be received in the toe-space 6 at the base of floor-standing furniture 8 to provide mechanical interference and thus help prevent tipping of the stool body 12 when a user on the top step 16 leans out of balance. In particular, if a user on the top step 16 leans back/proximally, the stability extension 14 in the toe-space 6 will be induced to pivot upward but will be blocked from doing so by contacting engagement with the overhang 4 of the cabinet 8 (i.e., the fixed overhang 4 of the fixed cabinet 8 withstands the pivotal force applied by the stability extension 14). And if the user leans forward/distally, the stability extension 14 in the toe-space 6 will be induced to pivot downward but will be blocked from doing so by contacting engagement with the floor 3, with the stability extension 14 thus effectively providing a wider stool-body base portion 28. Furthermore, the stability extension 14 being inserted into the toe-space 6 enables these benefits and at the same time enables the distal edge 26 of the top step 16 to still be positioned immediately adjacent the cabinet proximal side (e.g., doors or drawers) 5 to still provide for enhanced user safety as discussed above.

In typical embodiments, the stability extension 14 includes two opposite side extensions 34 that extend distally from the support-structure base portion 28 and at least one brace member 36 extending transversely between them for structural strength. For example, the depicted stability extension 22 has a generally rectangular side and top profile/shape (see FIGS. 3 and 4, respectively). In the depicted embodiment, the side extensions 34 of the stability extension 14 are integral portions of the support frame members 22 of the support structure 18. In other embodiments, the stability extension is a separate component attached to the support-structure base portion, has side extensions curved inwardly toward each other, has another side and/or top profile/shape (including triangular, trapezoidal, or another regular or irregular shape), and/or has another configuration as can be readily appreciated by persons of ordinary skill in the art.

The stability extension 14 has an upper surface 38 that provides the blocking engagement with the cabinet toe-space overhang surface 4. In typical embodiments, the stability extension's upper surface 38 is substantially flat/horizontal. This provides for contacting engagement at any point along the stability extension 14 to provide the intended functionality described herein, regardless of whether the toe-space overhang surface 4 is flat/horizontal or not. Additionally, the lateral and lower surfaces of the stability extension 14 can be rounded or more ornate to provide an aesthetically pleasing appearance for the step stool 10.

Also, the stability extension 14 has a height 40 (i.e., below its upper surface 38) that is less than the height of the toe-space 6. In some embodiments, the stability extension height 40 is minimally less than the toe-space height so that the stability extension 14 is received in the toe-space 6 with little vertical "play" or "wiggle room" to minimize any tipping (distal/proximal or lateral) of the stool 10 during use. In typical embodiments, the stability extension height 40 is about one-half inch to about 6 inches (for example about 2.5 to about 4.5 inches, or the depicted about 3.5 inches). Alternatively, the height 40 of the stability extension 14 can be customized to fit the particular toe-space 6 of a particular furniture piece 8.

In addition, the stability extension 14 has a distally extending depth 42 that is sufficiently long to provide the blocking engagement with the toe-space overhang surface 4 described above. At the same time, the stability extension's distally extending depth 42 is sufficiently short that it can be fully received into the toe-space 6 so that the top-step distal edge 26 can be positioned immediately adjacent the proximal surface (e.g., doors or drawers) of the cabinet 8. (For use with co-extensive toe-spaces such as for many beds and couches, the depth being sufficiently short is generally not a consideration). In this way, the depth of the stability extension 22 forms a sufficiently long radial moment arm to prevent unstable distal/proximal angular tipping of the stepstool, even when the toe-space 6 is more than insignificantly higher than the stability extension 14. In typical embodiments, the stability extension depth 42 is about 1 inch to about 12 inches (typically about 0.5 to about 5.5 inches, about 1.5 inches to about 3.5 inches, about 1.0 inches to about 3.0 inches, about 2.0 or 2.5 inches, or the depicted about 3.5 inches). Alternatively, the depth 42 of the stability extension 14 can be customized to fit the particular toe-space 6 of a particular furniture piece 8.

To enable use of the step stool 10 with the widest range of different furniture 8, the stability extension 14 can have a depth 42 selected at the lower end of these ranges. It will be understood that in practical use, while most intended toe-spaces 6 will received the entire depth/length of the stability extension 14, an occasional use might include a shallow-depth toe-space that does not fully receive the stability extension 14 and that results in the top-step distal edge 26 being spaced for example one-half inch or even one inch from the cabinet 8, and this is still contemplated as within the scope of the invention.

Furthermore, the stability extension 22 can have a width 44 that is sufficiently long to substantially eliminate lateral angular tipping (includes minimizing to no more than ten degrees) of the step stool 10 when the cabinet toe-space 6 is more than insignificantly higher than the stability extension 14, with one lateral end of the stability extension 14 pivoting only slightly upward into blocking contact with the toe-space overhang 4 while the opposite lateral end is blocked from pivoting downward because of its direct contact with the floor 3. That is, the stability extension width 44 is sufficiently long to provide blocking engagement with the overhang surface of the toe-space 6 when the stability extension is received in the toe-space and the stepstool 10 is tilted laterally, to prevent lateral angular tipping of the top step. In particular, the longer width 44 creates a longer radial moment arm between the side of the stability extension 22 that the user leans toward and overloads (thereby making it a pivot point) and the opposite side that is unweighted (thereby inducing it to pivot upward) so that the angle that the top step 16 can laterally tilt is minimized. For example, if there is one inch of vertical play or gap between the stability extension upper surface and the toe-space overhang surface, and the stability extension width is ten inches, the stability extension can only tilt by an angle of no more than about ten degrees before it is blocked in the toe-space 6. In some embodiments, the width 44 of the stability extension 22 can be substantially equal to that of the support structure 18. In the depicted embodiment, the width 44 of the stability extension 22 is greater than that of the top step 16 so that the user cannot have contacting support on the top step 16 laterally beyond the stability extension 22. For example, in embodiments with a top-step width of about 18 inches, the stability extension width can be greater than 18 inches, for example about 20 inches as depicted. In some embodiments, the stability extension width 44 is at least about 3 inches, and in other embodiments it is at least about 10 inches. Alternatively, the width 44 of the stability extension 14 can be customized for use with the particular toe-space 6 of a particular furniture piece 8.

Moreover, the top step 16 has a proximal edge 46 that is opposite its distal edge 26, and the subjacent bottom step 20 projects proximally (toward the user) from the support structure 18 and extends proximally beyond the top-step distal edge 26. As such, in embodiments with the bottom step 20 and the laterally outwardly angled support structure 18, the stool body 12 has a larger footprint (wider at the base) on both lateral sides and its proximal side. And the stability extension 14 on the distal side provides a larger footprint/base width on the fourth/distal side for optimized stability during use.

Figure 7:
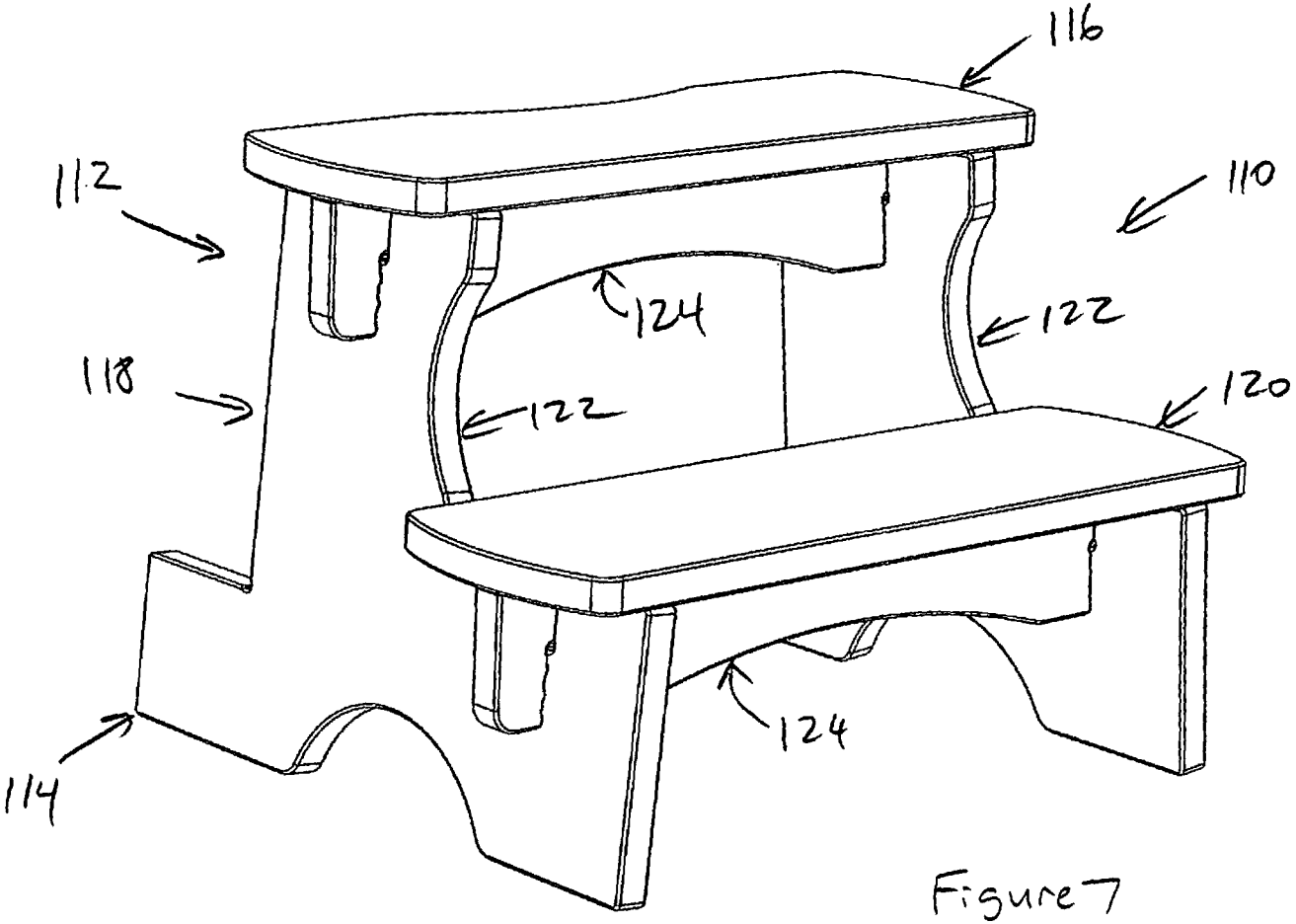
FIG. 7 is a front-side perspective view of a step stool with a stability extension according to a second example embodiment of the present invention.
Figure 8:
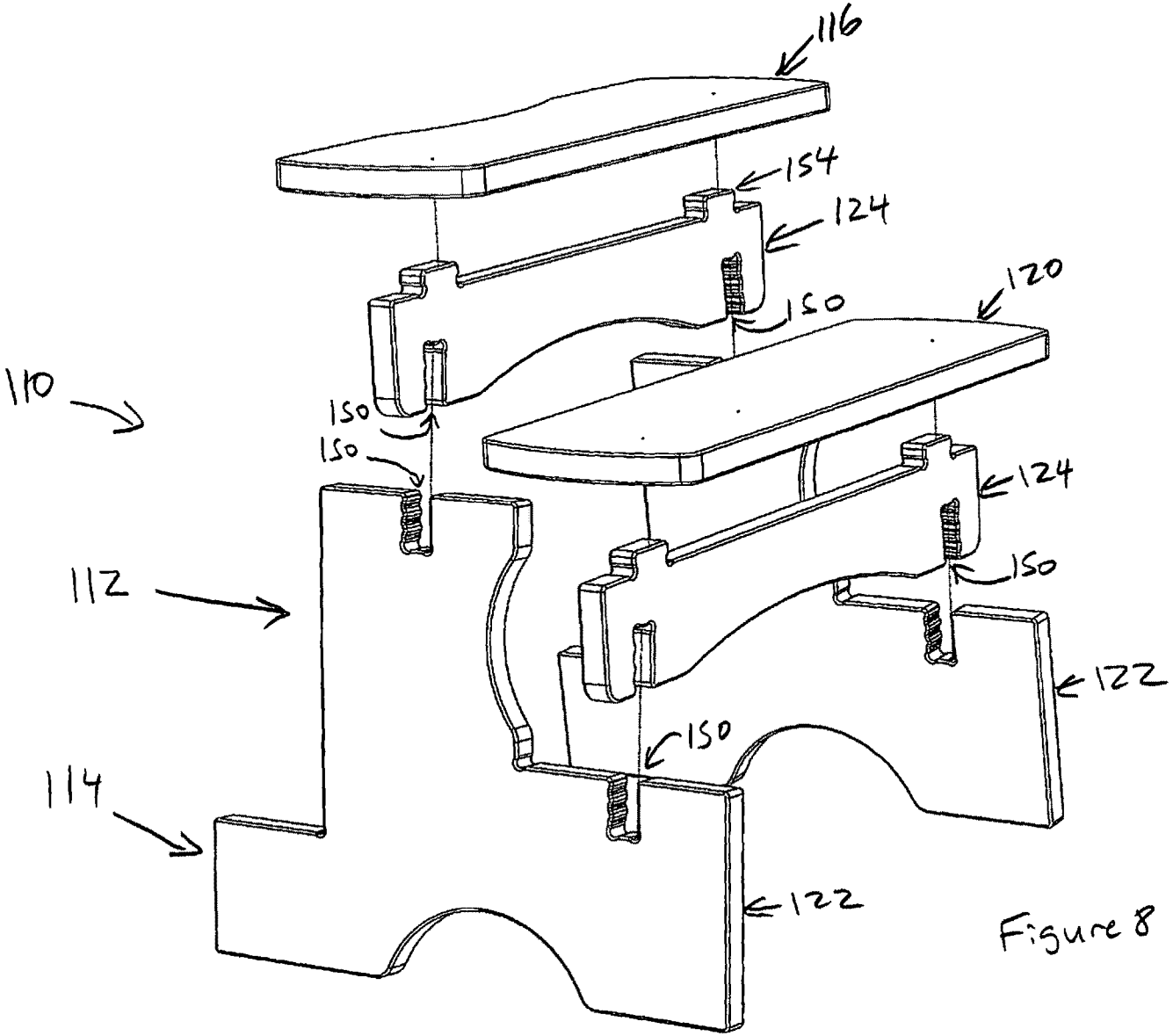
FIG. 8 is an exploded front-side perspective view of the step stool of FIG. 7.
Figure 9:
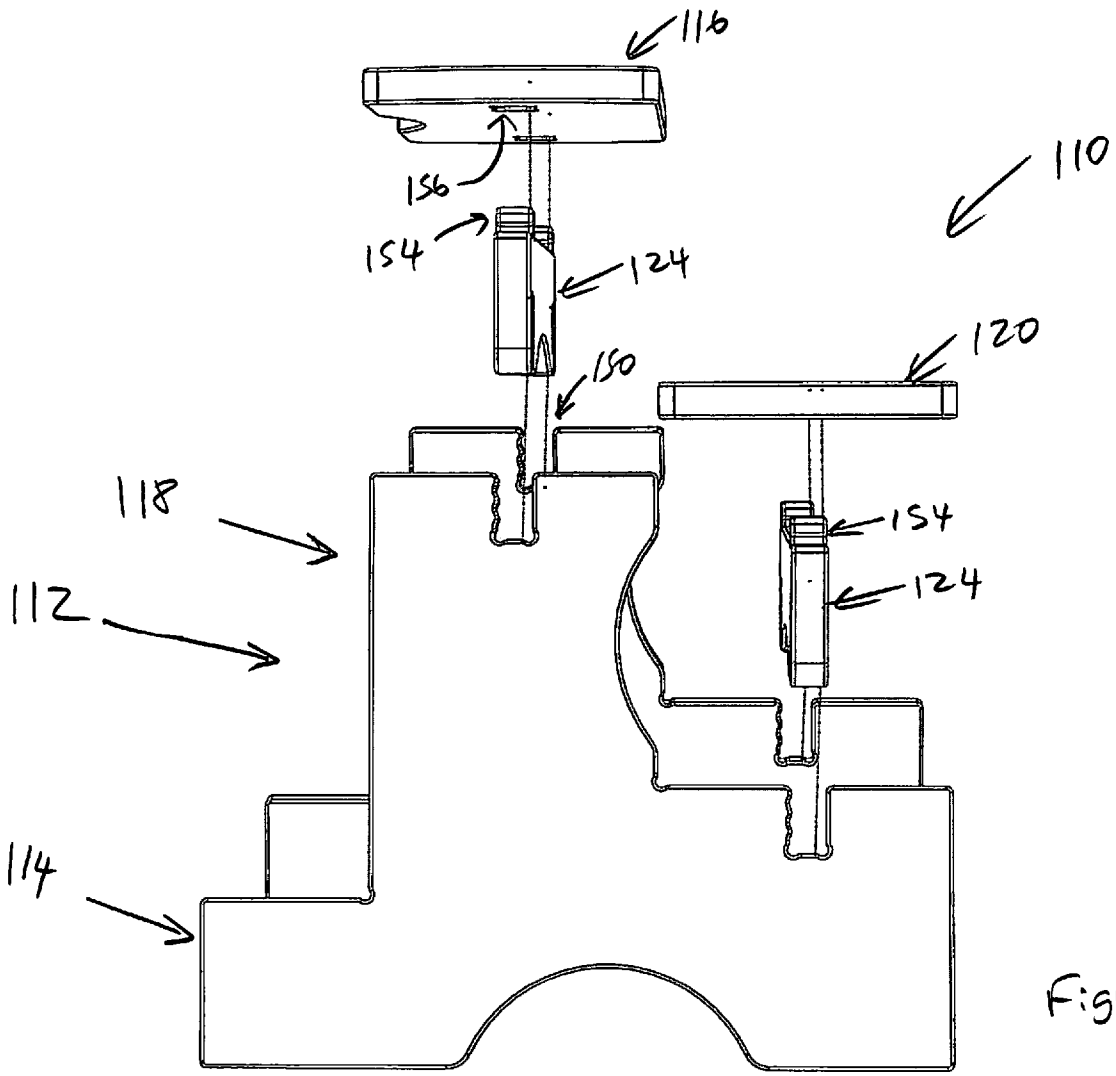
FIG. 9 is an exploded side perspective view of the step stool of FIG. 7.

FIGS. 7-9 show a step stool 110 according to a second example embodiment of the present invention. The stepstool 110 includes a stool body 112 and a stability extension 114 that are substantially similar to those of the first embodiment, except as noted. In particular, the stool body 112 includes a top step 116 and a bottom step 120 supported by a support structure 118 including two opposite side support frame members 122 and two transverse brace frame members 124.

In this embodiment, however, the brace members 124 are connected to the support frame members 122 by a mating-slot connection arrangement. For example, each of these components can have a slot 150 configured so that the slots 150 slide into each other in a mating fashion when the components are perpendicularly arranged, as depicted. In addition, the brace members 124 are connected to the top and bottom steps 116 by a tab-and-slot connection arrangement. For example, each of these components can have a tab 154 or a slot 156 configured so that the tabs 154 slide into the slots 156 in a mating fashion, as depicted. It will be understood that other mating joints can be used to interconnect the components of the stool body 112.

In other embodiments, the step stool includes a first distal stability extension and also includes a second/opposite proximal stability extension extending from the support structure beyond the proximal edge of the top step. The first and second stability extensions can be spaced laterally apart from one another on the support-structure frame, such that when the stability extensions are positioned in the top space 6 of the cabinet furniture 8, and the step stool begins to tip, one extension can engage the cabinet while the other maintains contact with the floor to help prevent the step stool from falling over. In some embodiments, the first and second stability extensions can be spaced apart from one another on the support-structure frame by at least 3 inches. In other embodiments, the first and second stability extensions can be spaced apart from one another on the support-structure frame by at least 10 inches. The second stability extension can be advantageous for step stools having only a single step (as a bottom/proximal step can contribute to this stability function).

In yet other embodiments, the stability extension has a top surface that is ramped (e.g., linearly, stepped, or curved) as it extends distally away from the support structure. This embodiment can be advantageous for use with a greater range of floor-standing furniture having a greater range of heights of toe-spaces. For example, the ramped stability extension can be engaged by the cabinet at a higher or lower point on the ramped surface when inserted into a toe-space that is taller or short, respectively (provided the toe-space is sufficiently deep for the farther insertion). Also, spacers or repositionable extension members can be provided on the step stool (e.g., at an upper portion of the distal side) for contacting engagement with the cabinet for enhance stability during use.

And in still other embodiments, the stability extension has an engagement device that is repositionable between an "up" position (extending above the stability extension upper surface) for use in a taller toe-space and a "down" position (retracted downward toward the stability extension upper surface) for use in a shorter toe-space. For example, the engagement device can be spring-biased toward the up position, ramped downward and away from the support structure, and retracted downward to the down position against the spring force by the force of engagement with the bottom of the cabinet forming the toe-space.

Another aspect of the present disclosure includes a method of reaching higher spaces than can be safely reached unassisted by using a step stool with a stability extension for enhanced user safety. The method can be implemented using any of the embodiments of the step stools 10 and 110 described herein and other step stools with variations or modifications that provide substantially the same functionality. And the method can be implemented in conjunction with floor-standing furniture with toe-spaces of the types described herein and furniture that the step stools can be used with to provide substantially the same functionality.

The method includes positioning the step stool on the floor adjacent a piece of floor-standing furniture having a toe-space and inserting the stability extension into the toe-space of the furniture until the top-step distal edge is immediately adjacent a proximal surface (e.g., doors or drawer) of the furniture above the toe-space. A user can then step up and stand on the top step to reach up or over the furniture item as may be desired.

It is to be understood that this invention is not limited to the specific devices, methods, conditions, or parameters of the example embodiments described and/or shown herein, and that the terminology used herein is for the purpose of describing particular embodiments by way of example only. Thus, the terminology is intended to be broadly construed and is not intended to be unnecessarily limiting of the claimed invention. For example, as used in the specification including the appended claims, the singular forms "a," "an," and "the" include the plural, the term "or" means "and/or," and reference to a particular numerical value includes at least that particular value, unless the context clearly dictates otherwise. In addition, any methods described herein are not intended to be limited to the sequence of steps described but can be carried out in other sequences, unless expressly stated otherwise herein.

While the claimed invention has been shown and described in example forms, it will be apparent to those skilled in the art that many modifications, additions, and deletions can be made therein without departing from the spirit and scope of the invention as defined by the following claims.

What is claimed is:

1. A stepstool for resting on a floor adjacent floor-standing furniture and for a user to ascend to reach a higher space above the floor, the stepstool comprising:

a stool body including a top step for supporting the user and a support structure that supports the top step above the floor, wherein the support structure has a base portion configured to rest on the floor and an upright portion supporting the top step, and wherein the top step extends laterally across the support structure and defines a distal edge; and a stability extension configured to provide enhanced stability for the stool body, wherein the stability extension projects distally from the base portion of the support structure, extends laterally side-to-side across the distal side of stepstool, and extends distally beyond the distal edge of the top step, wherein the stability extension is configured to be received in a use position in a toe-space at a base of the floor-standing furniture to provide mechanical interference and thereby prevent tipping of the stool body when the user on the top step leans out of balance.

2. The stepstool of claim 1, wherein the upright portion of the support structure has a distal side that does not extend distally beyond the distal edge of the top step, wherein with the stability extension in the use position received in the toe-space at the base of the floor-standing furniture, the stool body is positioned with the distal edge of the top step immediately adjacent a proximal upright surface of the floor-standing furniture to provide mechanical interference and thereby prevent tipping of the stool body when the user on the top step leans out of balance.

3. The stepstool of claim 2, wherein the distal side of the upright portion of the support structure and the distal edge of the top step are substantially vertical and substantially aligned.

4. The stepstool of claim 1, wherein the stability extension has an upper surface that engages and is blocked from upward movement by an overhang surface of the toe-space when the stool body is in the use position and tilted.

5. The stepstool of claim 1, wherein the stability extension has a width that is sufficiently long to provide blocking engagement with an overhang surface of the toe-space when the stability extension is in the use position received in the toe-space and the stepstool is tilted laterally, to prevent lateral angular tipping of the top step.

6. The stepstool of claim 5, wherein the stability extension width is greater than about 10 inches.

7. The stepstool of claim 5, wherein the stability extension width is greater than that of the top step so that the user cannot have contacting support on the top step laterally beyond the stability extension.

8. The stepstool of claim 1, wherein the stability extension has a distally extending depth that is sufficiently long to provide blocking engagement with an overhang surface of the toe-space when the stability extension is in the use position received in the toe-space and the stepstool is tilted, and that is sufficiently short that it can be fully received in the toe-space in the use position so that the top step distal edge is positioned immediately adjacent the floor-standing furniture, to prevent distal/proximal angular tipping of the top step.

9. The stepstool of claim 1, wherein the stability extension has a height that is less than a height of the toe-space.

10. The stepstool of claim 1, wherein the top step has a proximal edge opposite the distal edge, wherein the stool body further comprises a bottom step that projects proximally beyond the top step proximal edge, wherein the bottom step and the stability extension are oppositely arranged to provide a larger footprint at proximal and distal sides of the stepstool for improved stability of the stepstool, and wherein the bottom step and the stability extension have floor-contacting surfaces for stability.

11. A method of reaching a higher space than can be safely reached unassisted, the method comprising:

positioning the step stool of claim 1 on the floor adjacent the floor-standing furniture;

inserting the stability extension into the toe-space of the floor-standing furniture until the top-step distal edge is immediately adjacent a proximal surface of the floor-standing furniture, wherein the proximal surface is above the toe-space; and ascending the stepstool to the top step to enable safely reaching the higher space.

12. A stepstool for resting on a floor adjacent floor-standing furniture and for a user to ascend to reach a higher space above the floor, the stepstool comprising:

a stool body including a top step for supporting the user and a support structure that supports the top step above the floor, wherein the support structure has a base portion configured to rest on the floor and an upright portion supporting the top step, and wherein the top step has a distal edge; and a stability extension configured to provide enhanced stability for the stool body, wherein the stability extension projects distally from the base portion of the support structure and extends distally beyond the distal edge of the top step, wherein the stability extension has an upper surface that engages and is blocked from upward movement by an overhang surface of a toe-space at a base of the floor-standing furniture when the stool body is in the use position and tilted, and wherein the stability extension upper surface is substantially flat and horizontal, wherein the stability extension is configured to be received in a use position in the toe-space at the base of the floor-standing furniture to provide mechanical interference and thereby prevent tipping of the stool body when the user on the top step leans out of balance.

13. A stepstool for resting on a floor adjacent floor-standing furniture and for a user to ascend to reach a higher space above the floor, the stepstool comprising:

a stool body including a top step for supporting the user and a support structure that supports the top step above the floor, wherein the support structure has a base portion configured to rest on the floor and an upright portion supporting the top step, and wherein the top step has a distal edge; and a stability extension configured to provide enhanced stability for the stool body, wherein the stability extension projects distally from the base portion of the support structure and extends distally beyond the distal edge of the top step, wherein the stability extension has a height that is less than a height of a toe-space at a base of the floor-standing furniture, and wherein the stability extension height is about 2.5 inches to about 4.5 inches, wherein the stability extension is configured to be received in a use position in the toe space at the base of the floor-standing furniture to provide mechanical interference and thereby prevent tipping of the stool body when the user on the top step leans out of balance.

14. A stepstool for resting on a floor adjacent floor-standing furniture and for a user to ascend to reach a higher space above the floor, the stepstool comprising:

a stool body including a top step for supporting the user and a support structure that supports the top step above the floor, wherein the support structure has a base portion configured to rest on the floor and an upright portion supporting the top step, wherein the top step has a distal edge, wherein the support structure includes two spaced-apart side support members across which the top step extends, and wherein the side support members are angled outwardly so that the base portion is wider than the upright portion to provide a larger footprint at lateral sides of the stepstool for improved stability of the stepstool; and a stability extension configured to provide enhanced stability for the stool body, wherein the stability extension projects distally from the base portion of the support structure and extends distally beyond the distal edge of the top step, wherein the stability extension is configured to be received in a use position in a toe-space at a base of the floor-standing furniture to provide mechanical interference and thereby prevent tipping of the stool body when the user on the top step leans out of balance.

15. The stepstool of claim 14, wherein the side support members are angled outwardly by about 5 degrees to about 15 degrees.

16. A stepstool for resting on a floor adjacent floor-standing furniture and for a user to ascend to reach a higher space above the floor, the stepstool comprising:

a stool body including a top step for supporting the user and a support structure that supports the top step above the floor, wherein the support structure has a base portion configured to rest on the floor and an upright portion supporting the top step, and wherein the top step has a distal edge; and a stability extension configured to provide enhanced stability for the stool body, wherein the stability extension projects distally from the base portion of the support structure and extends distally beyond the distal edge of the too step wherein the stability extension has a distally extending depth that is sufficient long to provide blocking engagement with an overhang surface of a toe-space at a base of the floor-standing furniture when the stability extension is in a use position received in the toe-space and the stepstool is tilted, and that is sufficiently short that it can be fully received in the toe-space in the use position so that the too step distal edge is positioned immediately adjacent, the floor standing furniture, to prevent distal/proximal angular tipping of the top step, and wherein the stability extension depth is about 1.5 inches to about 3.5 inches, wherein the stability extension is configured to be received in the use position in the toe-space at the base of the floor-standing furniture to provide mechanical interference and thereby prevent tipping of the stool body when the user on the top step leans out of balance.

17. A stepstool for resting on a floor adjacent floor-standing furniture and for a user to ascend to reach a higher space above the floor, the stepstool comprising:

a stool body including top and bottom steps for supporting the user and a support structure that supports the top and bottom steps above the floor, wherein the support structure has a base portion configured to rest on the floor and an upright portion supporting the top and bottom steps, wherein the support structure includes two spaced-apart side support members across which the top and bottom steps extend, wherein the top step has a distal edge a proximal edge opposite the distal edge, and wherein the bottom step that projects proximally beyond the top step proximal edge; and a stability extension configured to provide enhanced stability for the stool body, wherein the stability extension projects distally from the base portion of the support structure and extends distally beyond the distal edge of the top step, wherein the stability extension is a configured to be received in a use position in a toe-space at a base of the floor-standing furniture to provide mechanical interference and thereby prevent tipping of the stool body when the user on the top step leans out of balance, wherein the bottom step and the stability extension are oppositely arranged to provide a larger footprint at proximal and distal sides of the stepstool for improved stability of the stepstool, and wherein the side support members are angled outwardly so that the base portion is wider than the upright portion to provide a larger footprint at lateral sides of the stepstool for improved stability of the stepstool.

18. The stepstool of claim 17, wherein the upright portion of the support structure has a distal side that does not extend distally beyond the distal edge of the top step, wherein with the stability extension in the use position received in the toe-space at the base of the floor-standing furniture, the stool body is positioned with the distal edge of the top step immediately adjacent a proximal upright surface of the floor-standing furniture to provide mechanical interference and thereby prevent tipping of the stool body when the user on the top step leans out of balance.

19. A stepstool for resting on a floor adjacent floor-standing furniture and for a user to ascend to reach a higher space above the floor, the stepstool comprising:

a stool body including a top step for supporting the user and a support structure that supports the top step above the floor, wherein the support structure has a base portion configured to rest on the floor and an upright portion supporting the top step, and wherein the top step has a distal edge; and a stability extension configured to provide enhanced stability for the stool body, wherein the stability extension projects distally from the base portion of the support structure and extends distally beyond the distal edge of the top step, wherein the stability extension is configured to be received to a use position in a toe-space at a base of the floor-standing furniture to provide mechanical interference and thereby prevent tipping of the stool body when the user on the top step leans out of balance, wherein the upright portion of the support structure has a distal side that does not extend distally beyond the distal edge of the top step, wherein with the stability extension in the use position received in the toe-space at the base of the floor-standing furniture, the stool body is positioned with the distal edge of the top step immediately adjacent a proximal upright surface of the floor-standing furniture to provide mechanical interference and thereby prevent tipping of the stool body when the user on the top step leans out of balance, wherein the stability extension has a distally extending depth that is sufficiently long to provide blocking engagement with an overhang surface of the toe-space when the stability extension is in use position received in the toe-space and the stepstool is tilted distally/proximally, and that is sufficiently short that it can be fully received in the toe-space in the use position so that the top step distal edge is positioned immediately adjacent the floor-standing furniture, to prevent distal/proximal angular tipping of the top step, wherein the stability extension depth is about 1.5 inches to about 3.5 inches, and wherein the stability extension has a width that is sufficiently long to provide blocking engagement with the overhang surface of the toe-space when the stability extension is in the use position received in the toe-space and the stepstool is tilted laterally, to prevent lateral angular tipping of the top step.

20. The stepstool of claim 19, wherein the stability extension width is greater than that of the top step so that the user cannot have contacting support on the top step laterally beyond the stability extension.

* * * * *